United States Patent [19]

Robson et al.

[11] Patent Number: 4,968,282

[45] Date of Patent: Nov. 6, 1990

[54] POSEABLE DOLL

[76] Inventors: George Robson, 829 Seventh St., Hermosa Beach, Calif. 90254; Gail C. Davidson, 405 S. 45th St., Boulder, Colo. 80303

[21] Appl. No.: 349,208

[22] Filed: May 8, 1989

[51] Int. Cl.[5] ..... A63H 3/46

[52] U.S. Cl. ..... 446/376; 446/383

[58] Field of Search ..... 446/376, 383, 382, 381, 446/371, 377, 379, 380, 384, 378

[56] References Cited

U.S. PATENT DOCUMENTS

| | | | |
|---|---|---|---|
| 2,653,415 | 9/1953 | Becker | 446/376 |
| 4,824,410 | 4/1989 | Sommer | 446/371 |

FOREIGN PATENT DOCUMENTS

| | | | |
|---|---|---|---|
| 382264 | 10/1923 | Fed. Rep. of Germany | 446/376 |
| 2431777 | 4/1975 | Fed. Rep. of Germany | 446/381 |
| 617389 | 2/1961 | Italy | 446/383 |

*Primary Examiner*—Mickey Yu

*Attorney, Agent, or Firm*—Lawrence I. Field

[57] ABSTRACT

A doll which can be posed in various life-like athletic positions. The doll is constructed of sub-units connected to one another by ball and socket joints. A skin which encloses the sub-units is secured to the sub units by insertion of appendages into sockets in the sub-units and by means of a fastener which snaps into a groove pinning the skin to the doll.

2 Claims, 2 Drawing Sheets

POSEABLE DOLL

This invention relates to a unique figurine or doll which can be posed in various life-like, athletic positions. More specifically it relates to a doll having an internal torso in sections which exhibit the shape and appearance of the skeletal, muscle and fatty areas and which can be moved relative to one another, covered with a skin which is secured to the sections of the torso by the figurine's limbs and head.

A principal object of the invention is to provide a poseable doll with a particularly life like appearance.

A further object of this invention is to provide a poseable doll which can shrug its shoulders.

Still another object is to create a figurine which can be posed in various athletic positions.

Still another object is to provide a figurine in which the skin is held in place by novel means which connect various appendages with the torso.

A further object is to provide a figure with a torso which comprises several individual interconnected elements which are universally moveable relative to each other thereby facilitating the poseability of the figure.

These and other objects are achieved in a figurine with a three piece internal torso shown in the following drawings in which.

Figure 6:
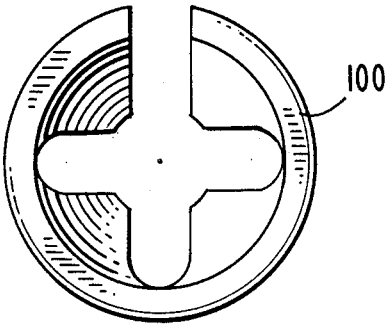

And FIG. 6 is a view showing the snap ring design for attaching the appendages to the torso elements.

Figure 1:
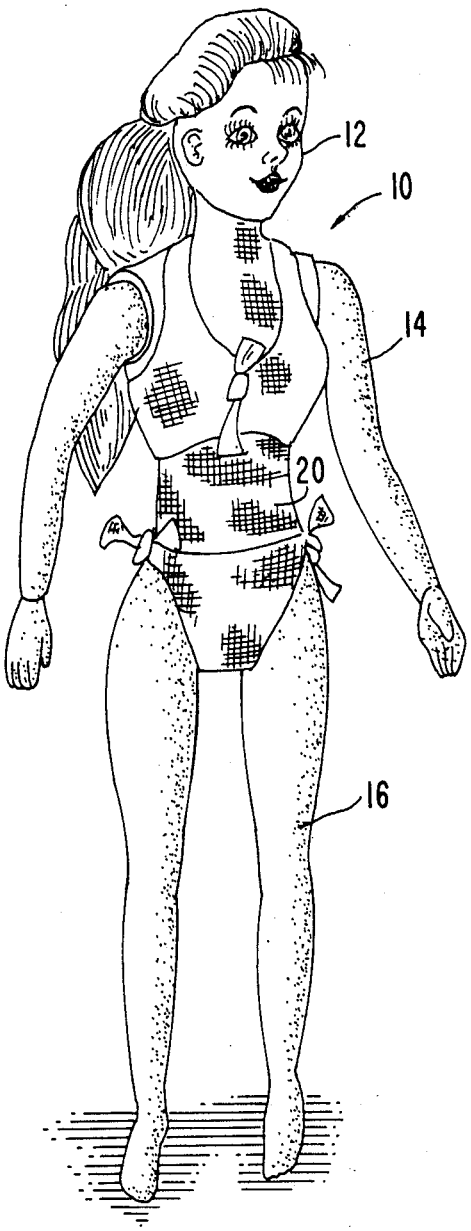
FIG. 1 is a view in perspective of a partially clothed figurine of the invention.
Figure 2:
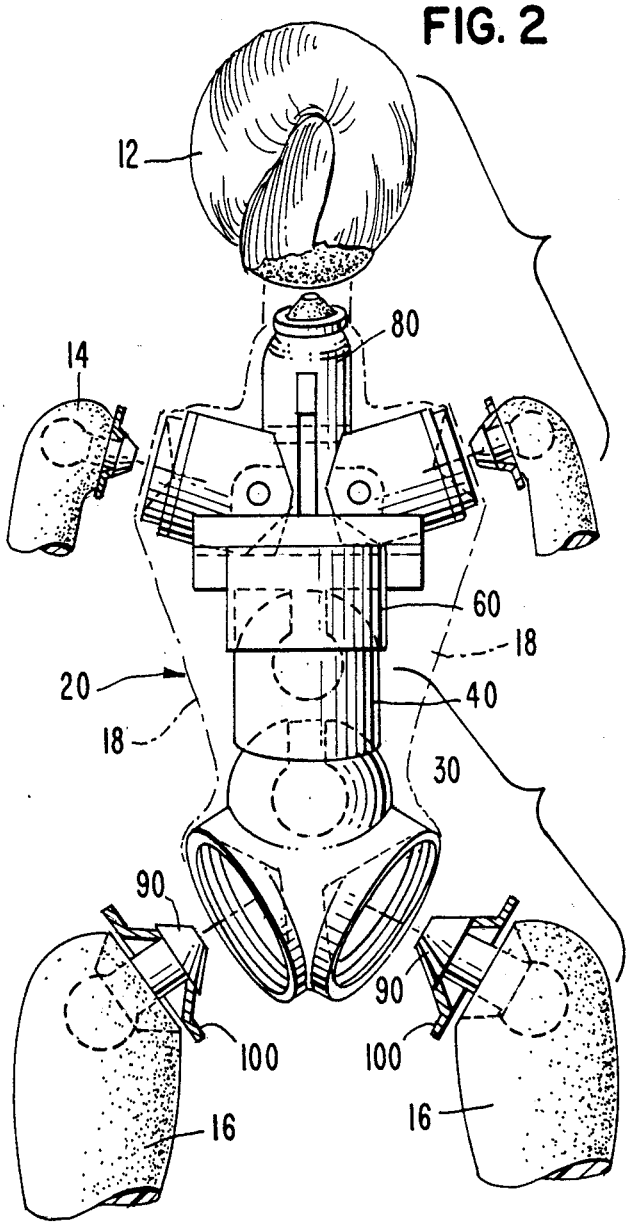
FIG. 2 is a schematic partially exploded view of the figurine of FIG. 1, illustrating the relationship of the components.

As best seen in FIG. 1 & 2, the figurine 10 comprises appendages such as a head 12, a pair of arms 14, and a pair of legs 16, assembled to a novel three piece internal torso 20 which is covered by a skin 18.

The internal torso 20 is covered by a thin semi-opaque skin 18 stretched tightly over the internal torso through which the anatomical features of the internal torso are indicated. This adds to the life-like appearance of the figurine and enhances the realism when the doll is posed. These features are not shown in the present drawings but will be present in the actual figurine. For instance, when the torso is posed in a bent over (forward) position the shapes of the spine and shoulder blades will be indicated as protruberances beneath the skin 18 and when the torso is posed in a bent over (backward) bent position the shapes indicating the bottom of the rib cage will be indicated as protruberances beneath the skin 18.

Figure 5:
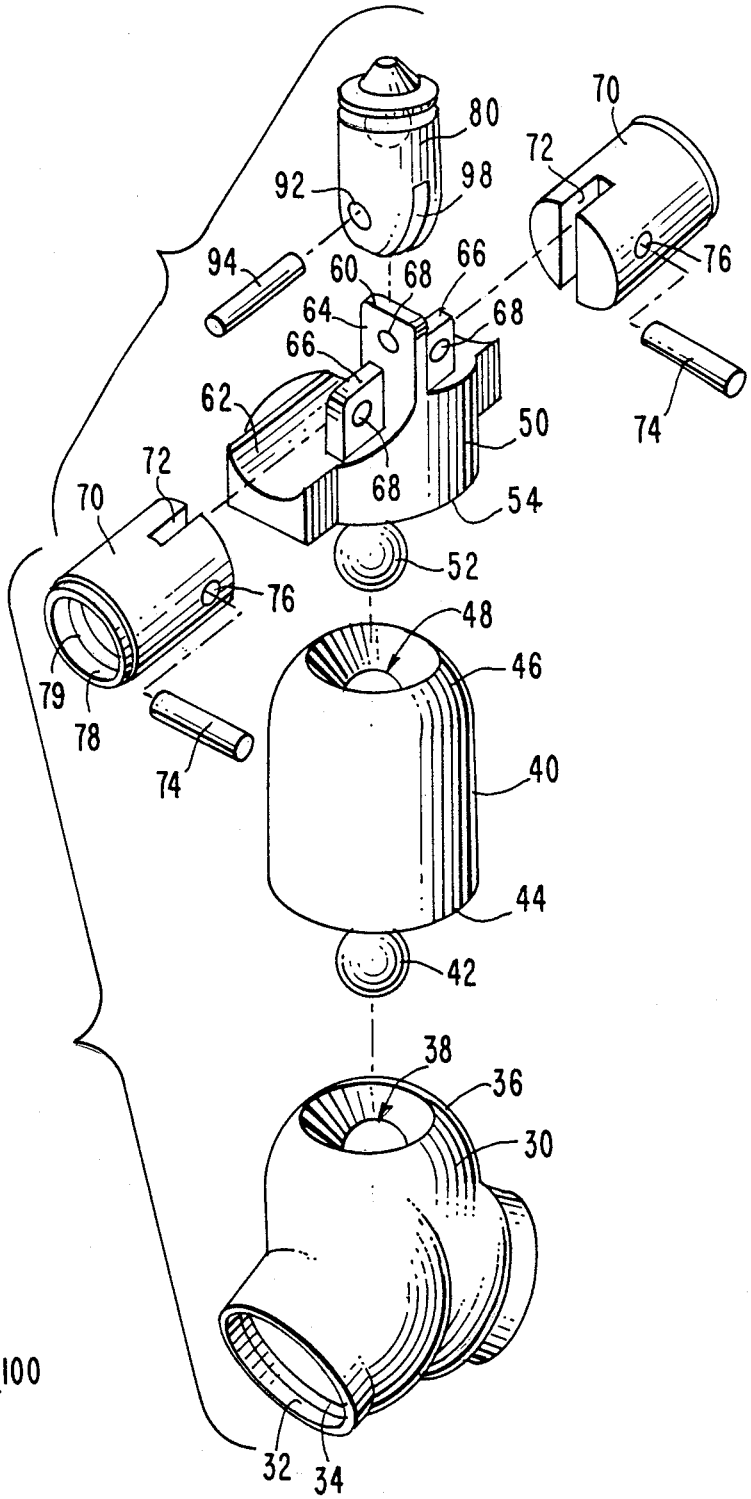
FIG. 5 is a more fully exploded view of the several components of the torso.

As shown in FIGS. 2 and 5, the torso 20 comprises a lower portion 30 corresponding to the pelvic region of the figurine, a middle portion 40 which corresponds to the stomach, diaphragm area and an upper portion 50 which corresponds to the rib cage and which supports a cruciform post 60 to which are connected two shoulder pieces 70 and a neck post 80. The upper, middle and lower internal torso portions include means for movably connecting them to one another. The lower portion, neck and shoulder pieces provide means for receiving the appendages which complete the figurine.

Thus the lower torso portion 30 of the internal torso 20 includes two sockets 32 adapted to receive legs 16. Each socket includes an annular groove 34 provided for attachment of legs 16 and skin 18 to the torso, in a manner to be described. The lower torso portion 30 has a top surface 36 that is ball-shaped and conforms to the lower surface of the middle torso portion 40.

The middle torso portion 40 includes a bottom surface 44 conformed to receive the top surface 36 of lower torso portion 30 and a ball shaped top surface 46 similar to that of the lower torso portion 30 which conforms to the lower surface 54 of the upper torso portion 50.

The upper torso portion 50 includes a lower surface 54 conformed to receive the top surface 46 of the middle torso portion 40.

The three portions of the torso are held together by means of ball shapes 42 and 52 which are on posts which extend respectively from the lower surface of the central portion 40 and upper portion 50 of the three piece torso and are trapped in an aperture 38 in the upper surface of the lower portion 36 and a similar aperture 48 in the top of the central portion 40 of the torso.

It will be seen that the attachment of the three torso portions to each other is by means of a swivel joint, a connection which can turn to the side in addition to pivot forward and backward.

The upper torso portion 50 also includes an upper surface on which a cruciform post 60 is located where the clavicle of the figurine would normally be located. Three pieces, two shoulder pieces 70 and a neck post 80 are attached to post 60 by pins about which each of the three pieces can pivot.

The cruciform post 60 extends upwardly from a bearing surface 62. Post 60 includes a vertical forwardly directed center portion 64 and two vertical sideways directed wings 66 extending laterally at right angles to the forwardly directed center portion 64. Apertures 68 are provided in portion 64 and wings 66. The bearing surface 62 provides support for the two shoulder pieces 70. Each shoulder piece is more or less cylindrical. At the inboard end of each cylinder a slot 72 is provided, dimensioned to receive a wing 66. A pin 74 which passes through a hole 76 in the slotted end of each shoulder piece secures the shoulder piece to wings 66. At the outer end of each of the shoulder pieces a socket 78 is provided to receive arms 14. Socket 78 includes a groove 79 shaped like groove 34 in leg socket 32 and is intended to receive a connector (FIGS. 6 and 3) consisting of a modified dumbell 90 and a snap ring 100. Dumbell 90 includes a ball 92 at one end which is received in limbs 14 or 16, a trunk 94 and a truncated conical head 96 on the end opposite the ball end.

Figure 3:
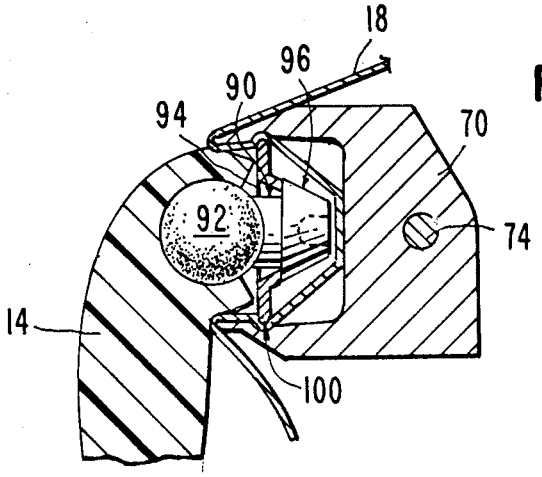
FIG. 3 is an enlarged view showing the connection between the torso, the skin and various appendages.
Figure 4:
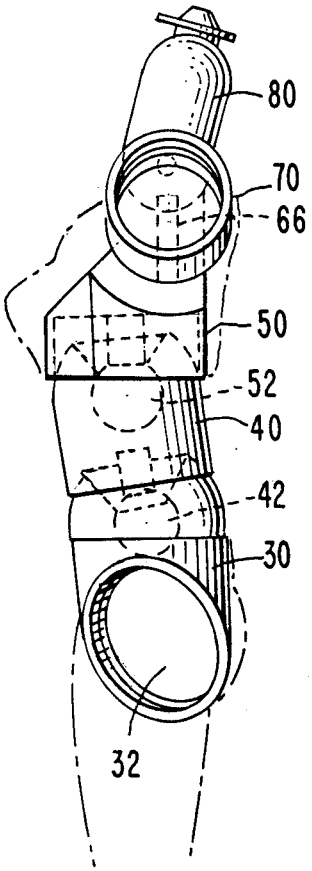
FIG. 4 is a side view, in perspective, of the torso with the shoulders in the shrug position.

The limbs are attached to the torso as shown in FIG. 3, Arms 14 and legs 16 are molded so as to terminate in a spherical socket. The appropriate section of the torso, e. g. shoulder 70 is provided with a recess 78 into which the end of arm 14 can be slipped.

Recesses 32 and 78 are provided with a grooves 34 and 79 into which a snap ring 100 can be inserted. One end of connector 90 is inserted into socket 32 or 78 namely the conical head 96 on the end of connector 90 oppsite to ball 92.

The attachment of the skin to the torso is accomplished as follows:

1. The skin is sewn, molded or knit into a tube shape which is closed at one end. The tube will be smaller in diameter at the waist.

2. The skin is slipped over the internal torso assembly and closed off at the crotch.

3. Snap ring configured retainers are placed in openings provided in the internal skeleton at arms and legs over the skin trapping it in position. The grooves in the internal torso assembly position the snap rings in place.

4. The arm or neck assembly is then snapped into the inside diameter of the same snap ring which is trapped into the internal torso assembly on the outside diameter.

5. The head is snapped over the neck over the skin trapping it in position. A recess similar to 32 and 78 with a groove similar to 34 and 79 in the head provides the attachment method.

The legs are connected to the lower segment of the torso by means similar to those which connect the arms to the torso.

Another feature of this doll is that it can shrug it's shoulders. This is accomplished by means of pin 74, hole 76 and slot 70 which provides a pivot for each of the shoulder blades.

Neck post 80 supports the head 12. The lower end of post 80 is provided with a slot 98 and fits on the vertical portion 64 of post 60. A pin 94 passes through hole 92 which traverses the slotted end of neck post 80. The above construction provides for the following movements:

1. The neck post 58 may rotate forward and backward, around a pivot point at the clavical(pin 94).

2. The shoulders 70 can pivot up and down (shrugging motion) around a point midway between the neck and shoulder(pin 72).

3. The central torso is divided into three pieces to provide bending forward and rearward in addition to rotation of 90 degrees in either direction from forward. There are detents in the torso (not shown) which position it in a neutral (straight forward and straight up) position. The legs and arms can swivel outward and move forward and backward at the hip or shoulder connection.

Having now described a prefered embodinent of the invention, it is not intended that it be limited except as defined in the appended claims.

1. In a doll which can be posed in a variety of poses, said doll including a body to which a head and limbs are each movably attached, the improvement which comprises: a torso which consists of an upper torso portion defining a rib cage and movable shoulder pieces and a neck each connected to said upper torso portion, a central torso portion defining a stomach and diaphragm, and a lower torso portion defining a pelvic region, said upper and lower torso portions being swivel connected to said central torso portion and being covered by a skin, and in which the swivel connection between the several torso portions includes a ball at the end of a spot-like extension extending downwardly from each of the upper and central torso portions and an aperture on the top surface of each of the lower and central torso portions to receive said extension whereby the individual torso portions are universally movable with respect to one another, and wherein said shoulder pieces are pivotally connected to said upper torso portion, and including sockets in each of said shoulder pieces and in said lower torso portion, a groove in each of said sockets, connector pieces each articulated to a limb and insertable into one of said sockets and a snap ring located on each of said sockets whereby the skin is pinned in each socket on said torso when each of said limbs and its connector piece is inserted into its socket.

2. In a doll which can be posed in a variety of poses said doll including a torso to which a head and limbs can be attached, and a skin covering said torso, the improvement comprising a connector piece connecting each limb with said torso, each connector piece being insertable into a socket in said torso and held by a snap ring located in a groove in said socket whereby the skin is pinned in the socket on said torso.

* * * * *